United States Patent [19]

Pesa

[11] Patent Number: 4,641,125

[45] Date of Patent: Feb. 3, 1987

[54] METER BEATER TIMER

[76] Inventor: Nastazio Pesa, 25-40 31st Ave., Long Island City, N.Y. 11106

[21] Appl. No.: 779,480

[22] Filed: Sep. 25, 1985

[51] Int. Cl.[4] ..... G08B 1/00; G04B 47/00; G04F 8/00; A44B 15/00

[52] U.S. Cl. ..... 340/309.15; 340/540; 368/8; 368/10; 368/109; 70/456 R

[58] Field of Search ..... 340/309.15, 52 D, 568, 340/540; 368/7, 8, 9, 10, 89, 90, 109; 70/456 R, 459, 460; 63/21; 446/314, 376; 194/900, 902

[56] References Cited

U.S. PATENT DOCUMENTS 2,596,374 5/1952 Crapster ..... 70/456 R 4,080,595 3/1978 Rosen ..... 340/568

*Primary Examiner*—Ulysses Weldon
*Assistant Examiner*—Ralph Smith
*Attorney, Agent, or Firm*—Richard L. Miller

[57] ABSTRACT

A meter beater timer is provided which alerts the user when a pre-determined time interval has expired so that he can return to the meter and deposit additional coins if necessary. Unlike previous timers, the user is reminded to set the timer when he withdraws the ignition key from the ignition. The key is attached to a key ring and to a key chain which retracts into the timer housing when the key is removed from the ignition depressing a plunger which sets off an alarm. An electronic version and a mechanical version are provided.

4 Claims, 5 Drawing Figures

METER BEATER TIMER

BACKGROUND OF THE INVENTION

The present invention relates generally to the field of timing devices and, more specifically to the field of timers which remind a user when a pre-determined time interval has transpired.

At present, parking meters can be found in almost every municipality in the nation. While the meter charges themselves are relatively nominal, the fines for parking adjacent to an expired meter are not. A number of inventions have been posited as solutions to this problem including a time indicating key holder by B. C. Crapster (U.S. Pat. No. 2,596,374) and a key case and watch combination by P. M. Wolski (U.S. Pat. No. 4,064,722). While these inventions are useful, they do not deal with perhaps the most important part of the time keeping process, i.e. remembering to set the timer.

SUMMARY OF THE INVENTION

It is, therefore, a primary object of the present invention to provide a meter beater timer which reminds the user to set the timer each time the ignition key is removed from the ignition.

Another object is to provide a meter beater timer which keeps sounding this alarm until an off button is pressed.

Yet another object is to provide a meter beater timer which may be provided in a mechanical version similar to a mechanical stop watch or as an electronic stop watch.

Still another object is to provide a meter beater timer in which the key is attached to a key chain which retracts into the timer housing in such a way that the key is held attached to the timer and that the alarm sounds when the key chain is forcibly nested into a cradle in the timer body.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
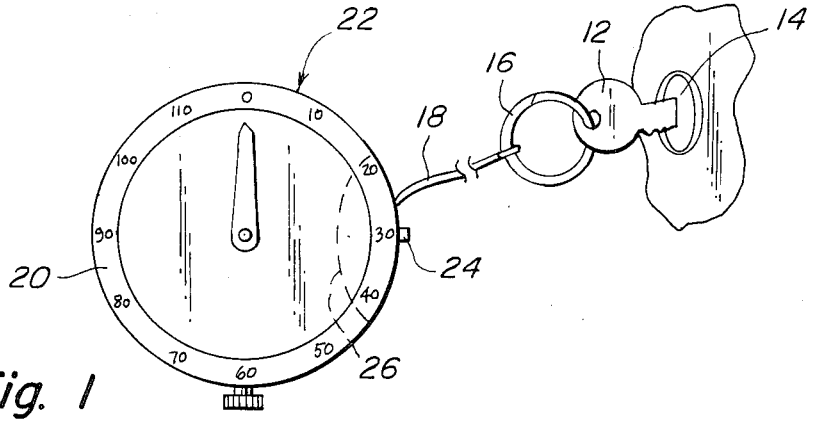
FIG. 1 is a front elevational view of a first embodiment of a typical mechanical version of the timer hanging from the ignition key of a motor vehicle.
Figure 2:
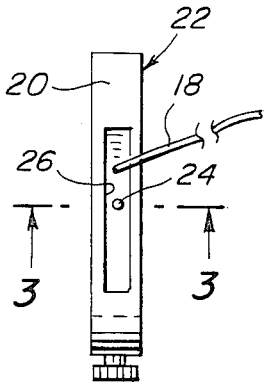
FIG. 2 is a side view thereof.
Figure 3:
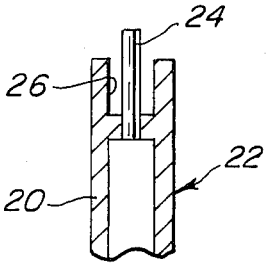
FIG. 3 is a cross sectional view taken on line 3—3 in FIG. 2.

The operation of the mechanical version of the invention may best be understood with reference to FIGS. 1, 2 and 3. In FIG. 1, key 12 is inserted into ignition 14. Key 12 is attached to key ring 16 which is, in turn, attached to retractable chain 18. In this position, the weight of timer housing 20 causes retractable chain 18 to be extended. When key 12 is withdrawn from ignition 14, chain 18 is drawn back into timer housing 20 of mechanical stop watch 22 causing plunger 24 to be depressed as key ring 16 is forcibly nestled into cradle 26 setting off an alarm which is typically found in mechanical stop watches such as 22. This alarm reminds the user that if he is stopped at a parking meter, attention should be paid to inserting coins into the meter and then setting the timer.

Figure 4:
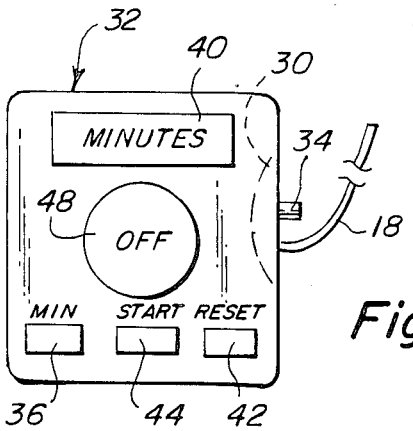
FIG. 4 is a front elevational view similar to that of FIG. 1 of a second embodiment of a typical electronic version of the timer hanging from the ignition key of a motor vehicle, except that the ignition key and switch are not shown.
Figure 5:
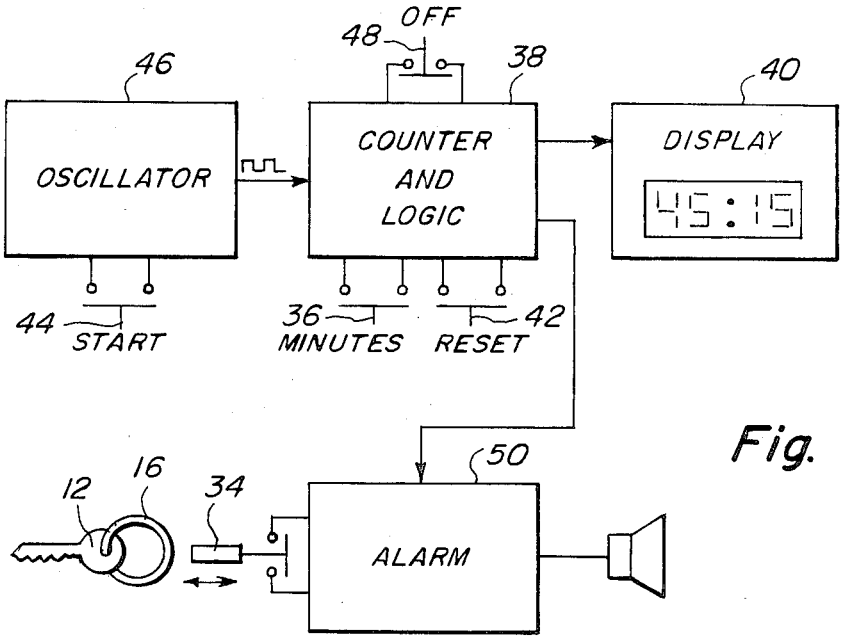
FIG. 5 is an electronic block diagram of the embodiment shown in FIG. 4.

The operation of the electronic version of the invention 30 based on electronic stop watch 32, may best be understood with reference to FIGS. 4 and 5. The operation of the alarm 50 which reminds the user to set his timer when the key is removed from the ignition is analogous to the mechanical version in that the returning key ring pushes plunger 34 into its cradle. The alarm 50 can only be turned off by depressing off button 48. In operation the minutes are set by depressing minutes button 36 which sets counter and logic module 38 causing display 40 to display the time interval. If the time is incorrect, reset button 42 may be depressed resetting counter 38. When the correct time is indicated, depressing start button 44 causes oscillator 46 to produce pulses which in turn causes counter 38 to decrement. When the counter reaches zero alarm 50 sounds alerting the user that the meter period has expired.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. A meter beater timer, comprising in combination:

(a) a timer housing;

(b) a interval timer, contained in said timer housing, wherein said interval timer is set to a preset time interval and counts backward from said preset timer toward zero;

(c) an alarm, contained in said timer housing;

(d) a stop button operatively coupled to said alarm, wherein said alarm sound when said interval timer has reached zero and wherein said alarm is turned off by depressing said stop button;

(e) a retractable chain connected to a key ring, such that said retractable chain is extended by the weight of said housing when a key attached to said key chain is inserted into an automobile ignition, and retracts into said timer housing when said key is removed from said ignition thereby releasing tension on said key and said key chain; and, (f) means for activating said alarm when said key is removed from said ignition and said retractable chain retracts.

2. A meter beater timer, as recited in claim 1, wherein said interval timer is a mechanical stop watch.

3. A meter beater timer, as recited in claim 1, wherein said interval timer further comprises an oscillator which produces pulses which are initiated by the actuation of a start button; a resetable counter with logic which can be set to begin counting backward at the desired number of minutes and sends an initiation signal to said alarm; and a display which indicates the number of minutes and seconds which have elapsed since said count began.

4. A meter beater timer, as recited in claim 1, wherein said means for activating said alarm when said key is removed from said ignition, comprises a plunger which activates said alarm, and a cradle comprising a circular notch in the side of said timer housing, such that when said retractable chain retracts said attached key chain is forcibly nested into said cradle, forcing said plunger inward thereby activating said alarm.

* * * * *